United States Patent [19]

Saulnier

[11] B 3,981,729

[45] Sept. 21, 1976

[54] PHOTOGRAPHIC METHOD EMPLOYING ORGANIC LIGHT-SCATTERING PARTICLES FOR PRODUCING A VIEWING-SCREEN STRUCTURE

[75] Inventor: Theodore Alexander Saulnier, Lancaster, Pa.

[73] Assignee: RCA Corporation, New York, N.Y.

[22] Filed: May 14, 1973

[21] Appl. No.: 359,901

[44] Published under the second Trial Voluntary Protest Program on January 13, 1976 as document No. B 359,901.

[52] U.S. Cl. ..... 96/36.1; 427/64; 427/68; 96/93; 96/115 R

[51] Int. Cl.[2] ..... G03C 5/00

[58] Field of Search ..... 96/36.1, 115 R, 93; 117/33.5 C, 33.5 CM, 33.5 CP; 427/64, 68

[56] References Cited

UNITED STATES PATENTS

| | | | |
|---|---|---|---|
| 3,589,907 | 6/1971 | Dijkstra | 96/36.1 |
| 3,623,867 | 11/1971 | Saulnier | 96/36.1 |
| 3,661,580 | 5/1972 | Mayaud | 96/36.1 |

*Primary Examiner*—Edward C. Kimlin
*Attorney, Agent, or Firm*—G. H. Bruestle; L. Greenspan

[57] ABSTRACT

Method comprises coating a supporting surface with a film consisting essentially of a polymeric photobinder containing light-scattering particles of an organic, insoluble, volatilizable material; exposing the film to a light image developing the film; and adhering particles of screen structure material to the film before or after developing the film.

3 Claims, 1 Drawing Figure

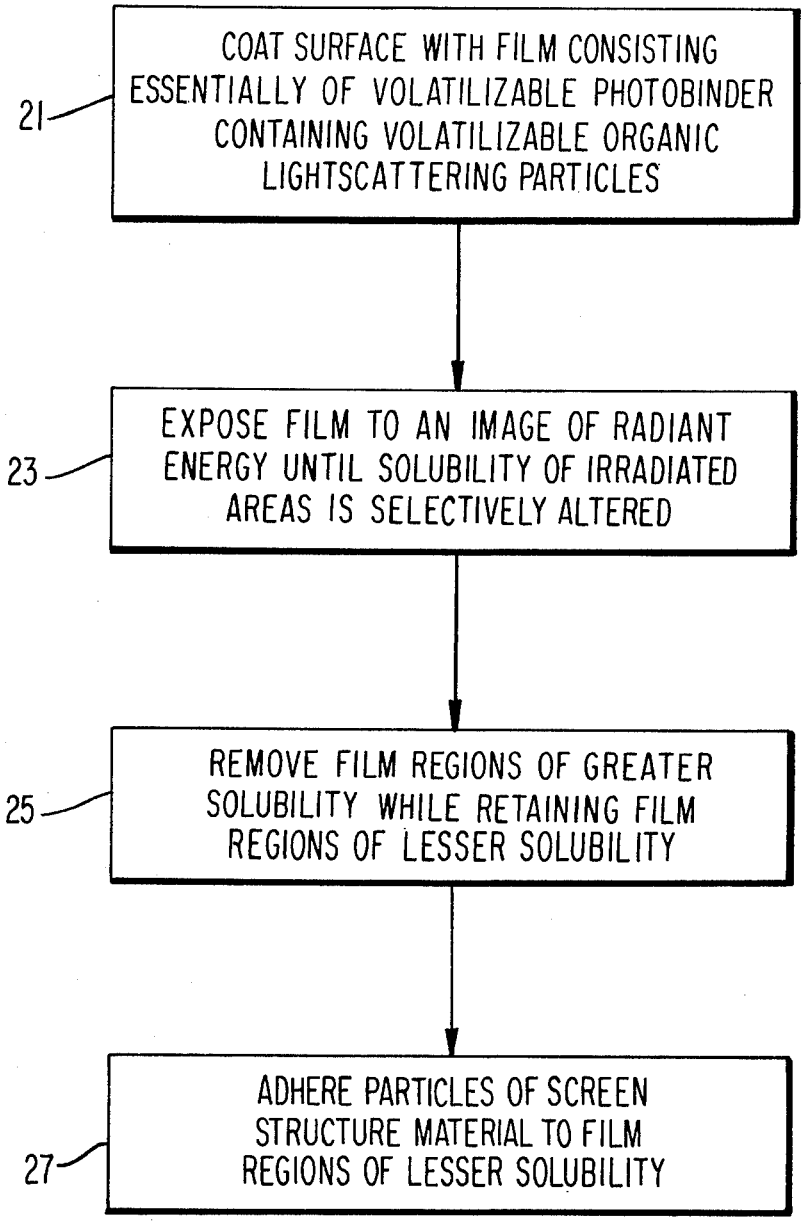
21
COAT SURFACE WITH FILM CONSISTING ESSENTIALLY OF VOLATILIZABLE PHOTOBINDER CONTAINING VOLATILIZABLE ORGANIC LIGHTSCATTERING PARTICLES
23
EXPOSE FILM TO AN IMAGE OF RADIANT ENERGY UNTIL SOLUBILITY OF IRRADIATED AREAS IS SELECTIVELY ALTERED
25
REMOVE FILM REGIONS OF GREATER SOLUBILITY WHILE RETAINING FILM REGIONS OF LESSER SOLUBILITY
27
ADHERE PARTICLES OF SCREEN STRUCTURE MATERIAL TO FILM REGIONS OF LESSER SOLUBILITY

PHOTOGRAPHIC METHOD EMPLOYING ORGANIC LIGHT-SCATTERING PARTICLES FOR PRODUCING A VIEWING-SCREEN STRUCTURE

BACKGROUND OF THE INVENTION

This invention relates to a method for producing a viewing-screen structure; for example, for a cathode-ray tube.

In U.S. Pat. No. 3,533,719, issued Oct. 13, 1970 to Louis J. Angelucci, Jr., there is described a photographic method for producing a luminescent viewing screen for a cathode-ray tube. That method comprises coating a supporting surface with a film consisting essentially of organic polymeric binder material whose solubility is altered when it is exposed to radiant energy (photobinder) and particles of inorganic light-scattering material. The film is exposed to an image in the form of radiant energy, thereby producing regions of greater solubility and regions of lesser solubility in the film. The exposed film is developed by removing the regions of greater solubility and retaining the regions of lesser solubility. Particles of screen-structure material, such as phosphor particles, are adhered to the film regions of lesser solubility either before or after developing the film. The amount of material that remains adhered has, heretofore, usually been limited to a closely-packed monolayer of particles. This may cause variations in light output as well as low light output, as compared with a multilayer of particles. The retained film regions carrying the screen-structure material are baked at temperatures below about 500°C to volatilize the organic material that is present.

The particles of light-scattering material in the film serve the function of increasing the efficiency of the exposing step, thereby shortening the exposure (time and/or intensity) required. Also, the light-scattering particles produce a more uniform exposure in the irradiated regions of the film. The light-scattering particles disclosed in the cited Angelucci patent are exemplified by dibasic calcium phosphate, milk of magnesia, magnesium silicate, and talc. All of these materials are inorganic and are not volatilized below about 500°C. As a result, a residue of the light-scattering particles remains after the structure has been baked. Such residue has the effect of reducing the efficiency or degrading the performance of the viewing screen. Also, some of these materials dissociate in water and have an adverse effect on the physical properties of the films produced, and on the method in general.

SUMMARY OF THE INVENTION

The novel method follows generally the steps in the prior method described above except that the dry film contains about 10 to 80 weight percent, with respect to the weight of polymeric binder material present, of light-scattering particles of an insoluble, volatilizable, organic material. The organic light-scattering particles are preferably about 0.3 to 1.0 micron median size and are volatilized at temperatures below about 500°C.

By employing volatilizable, organic, light-scattering particles, disabilities of the prior method can be overcome. The particles can be removed by volatilization during the baking step, leaving substantially no residue to reduce the efficiency or degrade the performance of the viewing screen. Also, the particles have no adverse effect on the physical properties of the films produced, or on the method in general. However, all of the advantages of the use of light-scattering particles in the film are realized.

Also, and unexpectedly, it has been found that the wet film after exposure imbibes large quantities of solvent. These large quantities of solvent are quite mobile and, when the particles of screen structure material are applied, the solvent moves into the applied particles, as by capillary action, which makes it possible to adhere large amounts of particles to the film. It is believed that small amounts of photobinder dissolve or disperse into the mobile solvent and further aid in adhering the particles to the film.

BRIEF DESCRIPTION OF THE DRAWING

The sole FIGURE is a flow-chart diagram of the novel method.

DETAILED DESCRIPTION OF THE PREFERRED EMBODIMENTS

In printing photobinder patterns by the image-projection technique commonly employed to make color-television picture screens, there is a tendency for the retained image areas to feather towards the edges of the areas so as to form very thin and weak film regions. For a film coated over a stippled panel, the intensity gradation of light falling on the film is further modulated by this surface so that the underexposed areas of the film, particularly in the penumbra areas at the border of the exposed areas, are very ragged.

Earlier patents, for example the above-cited U.S. Pat. No. 3,533,719 and my U.S. Pat. No. 3.623,867 issued Nov. 30, 1971, disclose that the edges of the exposed film regions can be better exposed when light-scattering inorganic particles are included in relatively small concentration in the film to permit sufficient light to pass through the film so as to gain adherence and yet with enough light scattering to make more efficient use of the actinic light. It is believed that the presence of such particles helps further by scattering light from relatively overexposed high-intensity umbra and penumbra areas into nearly underexposed penumbra areas. The net effect after developing is to produce larger, well-defined, retained film regions for the same exposure with a more abrupt slope in the penumbra areas, so that the edges of the retained film regions are less feathered and are less subject to folding over or tearing during development. Irregular borders caused by the stippled glass surface are greatly moderated and integrated into a more regular shape. Without the light-scattering particles, light rays run into, or glance along, stipple prominences so that the ray paths are shortened or lengthened accordingly.

The use of inorganic particles, which leave a residue after baking out, may be unacceptable where the film material must be removed by baking-out in air. A residue of inorganic particles can be a problem when the residue remains on a television-tube-panel surface between the phosphor and the viewer and interferes with light transmission or causes an unacceptable appearance under ambient light. A residue of inorganic particles can also be unacceptable when it is in or on the phosphor layer where it intercepts electron-beam energy and causes a loss in electron-beam energy or causes an unacceptable pattern on the screen during tube operation.

In the novel method, particles of a volatilizable organic material scatter light in the photobinder film. Some materials that may be used are particles of finelyground crystals of terphenyl or ground particles of polymeric materials, such as Acryloid K120 milled to a fine particle size (200 mesh, for example). More convenient materials to use are relatively large-particle organic polymeric materials in stable emulsion which have high light-scattering properties. The selection of a particular organic light-scattering material for a particular application is empirical depending in part on such factors as particle size, agglomerate size, and polymer hardness. The organic polymeric particles should preferably be relatively nonfilm-forming as applied so that they have considerable light-scattering properties when present in a dried photobinder film and permit the film to be developed easily.

Performance of the photobinder films suggests that the developed and still wet retained film regions contain considerable interstitial water together with dissolved or dispersed photobinder that was not insolubilized or completely leached out plus additional water and dissolved or dispersed photobinder under the remaining feather edge of the retained film regions. The retained film regions also appear to have the ability to transport and release this water and dissolved photobinder rapidly to the dry interstitial capillaries of the dry phosphor powder subsequently dusted onto the image. Thereby, a larger amount of phosphor is adhered on the retained film regions after water rinsing of the dusted phosphor powder from the nonimage areas than would be retained without the polymeric light-scattering particles.

The sole FIGURE indicates by flow sheet the principal steps of the novel method. In the first step, indicated by the box 21, a supporting surface is coated, as by dipping, spraying, flow coating, or spin coating, with a liquid suspension consisting essentially of a liquid vehicle, a volatilizable photobinder dissolved or dispersed therein, and volatilizable organic light-scattering particles dispersed therein. The coating is dried to form a film, which is preferably unbroken and uncrazed, since this will produce the sharpest, cleanest images. To this end, it is preferred that the photobinder be film-forming either directly upon deposition or during a heating step subsequent to deposition. The photobinder is preferably dichromatized polyvinyl alcohol, but may be any of the photobinders mentioned in column 4 of my above-cited U.S. Pat. No. 3,623,867.

The light-scattering particles are organic, insoluble in the photobinder, and volatilizable at temperatures below about 500°C to leave a negligible residue. In this specification, the term "volatilizable" includes the ability to reduce the material to vapor or to gaseous components by evaporation, sublimation, oxidation, thermal degradation, or a combination thereof. The preferred median particle size of the light-scattering particles is about 0.3 to 1.0 micron (300 to 1000 nanometers). The range in the size of the light-scattering particles covers reasonable practical limits for light scattering and interstitial spacing to "store" liquid, but it does not preclude using larger, less efficient particles. The light-scattering particles may be an acrylic polymer, such as Acryloid K120 marketed by Rohm and Haas, Philadelphia, Pa. ball-milled to size; or a polystyrene polymer, such as Plastic Pigment XD7226 marketed by Dow Chemical Company, Midland, Mich.; or an acrylic polymer marketed by Morton Chemical Co., New York, New York. Morton Chemical Company markets several emulsion polymers, called Opacifiers, which are easy to employ as light-scattering agents in waterbased photobinder films. Opacifiers E153, E300 and E305 have proven most useful in preparing photobinder films with excellent particle pickup. Opacifiers E284, 288 and 395 gave considerable improvement over other film formulations with no organic particles added.

It is possible to improve the physical properties of the film formulation of the developed film by including in the formulation small amounts of other materials which affect, for example, the wetting characteristics or the viscosity of the formulation; or which affect, for example, the plasticity or the affinity for water of the film. But these are optional ingredients and not essential to the formulation.

Sometimes, it is convenient to express the ingredients of the photobinder solution as a weight ratio. The weight ratio of the inert light-scattering particles to the polymeric photobinder should be in the range of about 0.10 to 0.80. This is considerably lower than proportions normally used for pigmentation or opacification where the weight ratios are generally 2.0 and higher. The weight ratio of photosensitizer to polymeric photobinder should be in the range of about 0.01 to 0.30.

The photobinder film is volatilizable at tempertures below 500°C. The photobinder film may be of the type which is insolubilized when exposed to energy in the form of rays of actinic light or electrons. Such photosensitive materials are referred to herein as negative-acting. Instead, one may use a photosensitive material of the type which is solubilized when exposed to radiant energy. This latter type of photosensitive material is referred herein as positive-acting.

In the second step, indicated by the box 23 of the sole FIGURE, the film is exposed to an image of radiant energy until the solubility of the irradiated areas of the film is selectively altered. The photographic master and the photoexposure may be similar to those described in the above-cited U.S. Pat. Nos. 3,533,791 and 3,623,867.

The mechanisms which produce the improvement in optical properties in the novel method are not entirely understood, but they are believed to be related to light scattering within the film by the particles or aggregates of the added particulate materials. The scattering effect is particularly surprising since the indices of refraction of the photobinder and the particles are relatively close to one another. This scattering tends to reduce lateral travel of light through the coating and to enhance the utilization of light in the exposed area on which the light is incident. The effect is to produce a more uniform hardening and a better-defined image of the illuminated areas of the film. The incident light is believed to be more uniformly diffused and absorbed in the localized regions of the film.

In the third step, indicated by the box 25 of the sole FIGURE, film regions with greater solubility in a particular solvent are removed, while film regions with lesser solubility are retained. Development of the exposed film may be carried out as described in the above-cited U.S. Pat. Nos. 3,533,791 and 3,623,867.

There is a considerable improvement in the water (solvent) storage and transport properties of the retained film regions of the developed image over the entire image area. When the phosphor powder is dusted onto the wet retained film regions, unexpectedly increased amounts of powder are adhered to the retained film regions. Drying and rewetting of the retained film regions result in a reduced quantity of adhered powder. Screen weights deposited with a tacky dot system used by a prior method employing a dichromatized polyvinyl alcohol as a photobinder deposited about 1.50 to 1.80 mg/cm² of phosphor. Screen weights obtained with a tacky dot system using the novel method range up to 6.0 mg/cm². Screen weight reduction can be obtained by adjusting the rate at which the phosphor powder is applied over the wet resist image, and by adjusting the water in the resist layer through faster or longer spinning of the wet screen prior to dusting on the phosphor powder.

In the fourth step, indicated by the box 27 of the sole FIGURE, particles of screen-structure material are adhered to the regions of lesser solubility. The screen-structure material may be luminescent or nonluminescent particles, such as manganese dioxide. In either case, the screen-structure material may be applied as by dusting to the film after exposing (second step) and before developing (third step), provided the film is tacky; or may be applied to the retained film regions as by dusting after developing (third step) and before any drying provided the film regions are wet. This last technique is referred to in the art as the "tacky dot" process.

There are a number of suitable devices sold for applying powders or "flocking" material over a tacky or wet surface. One such device which permits careful metering of phosphor powder is the Mateer Special Electric Filler, Model 15-AC, made by the G. Diehl Mateer Co., Wayne, Pa. 19087. It has a large hopper to hold phosphor powder. The powder is fed by an auger to a venturi chamber, from which it is dispersed by low (15 to 20 pounds) pressure air. The dispersed powder travels out of the venturi into a hose which conducts it to a nozzle. The nozzle contains a small high pressure air jet which propels the particles at a sufficient velocity to impinge on the wet or tacky surface.

The amount of particles adhered is related to the thickness of the retained film regions and the mobility of the water-polymer phase throughout the volume of the film regions and under the penumbra areas. Control of these quantities through formula adjustment can be obtained by varying the ingredients in the formulation given and the processing parameters without departing from the spirit of the invention. Additionally the amount of powder deposited is dependent on the rate at which powder is applied. The higher the powder-to-air ratio in the dust cloud, the less drying out of the wet image occurs during the powder application.

With the use of the light-scattering and the water-storing capillary structure provided by the polymeric particulate materials, the dusted phosphor image no longer shows the distinct ring-type configuration in the deposited phosphor. The improved-quantity and more-evenly-deposited phosphors provide more even water (solvent) storage and water transport within the umbra (center) penumbra (edge) areas of the retained image areas, rather than differences in "tackiness" between these areas. This may also include in part the mobility of the relatively soft, highly-swollen, loose structure of the retained film regions.

The following example is an embodiment of the novel method for depositing a pattern of luminescent areas for a viewing screen of a cathode-ray tube by the tacky-dot process.

EXAMPLE

A liquid suspension is prepared by mixing the following solutions and suspensions:

411.18 grams water
6.30 grams aqueous solution of dispersing agent, 5% active, such as Pluronic L72 marketed by Wyandott Chemical Co.,
315.00 grams aqueous solution of polyvinyl alcohol solution, 10% solids
57.27 grams aqueous suspension of filler resin containing 20% solids, such as Rhoplex C-72 marketed by Rohm and Haas, Philadelphia, Pa.,
78.75 grams aqueous suspension of light-scattering particles having 20% solids, such as Opacifier E305 marketed by Morton Chemical Co.,
31.50 grams aqueous solution of sensitizer for polyvinyl alcohol containing 10% solids, such as sodium dichromate.

The following sequence of steps is used to prepare a phosphor-dot pattern on a glass-faceplate panel for a shadow-mask-type color television picture tube:

1. Clean the surface of a 25-inch rectangular glass faceplate panel with a 1 to 5% solution of hydrogen fluoride or ammonium bifluoride solution.
2. Rinse the panel with water and drain off the excess water.
3. Precoat the still wet panel with a solution containing 0.2 to 0.5 weight percent polyvinyl alcohol, and drain off the excess solution to provide a precoated panel.
4. Dry the precoated panel.
5. Coat the precoated panel with the liquid suspension described above and drain off the excess.
6. Dry the retained film with moderate heat below about 50°C. Careful and consistent drying procedures yield the most repeatable results.
7. Insert the shadow mask in the faceplate panel and place the panel on a lighthouse.
8. Expose the dried film to light or other radiant energy from a small area light source until the solubility of the exposed (irradiated) regions of the film are selectively reduced, thereby producing regions of greater solubility and regions of lesser solubility in the film.
9. Remove the shadow mask from the faceplate panel.
10. Selectively remove the regions of greater solubility (those regions not irradiated) while retaining the regions of lesser solubility (the irradiated regions), as by exposing the film to a spray of water until the film is completely developed.
11. Spin off the excess water from the film quickly, but do not dry the developed film.
12. While the retained film regions are still wet and swelled with water, dust dry phosphor particles thereon until the retained film regions hold as much as they can. It appears that interstitial water carries some leached photobinder into the dry particles to adhere the particles to the retained film regions and to one another. Wet areas between the retained film regions lack leached photobinder and rinse off easily.
13. Dry at about 50° to 60°C the dusted film regions.
14. Apply a spray of water to the dry screen to remove any excess phosphor-powder particles from areas of the structure between the dusted retained film regions.

The phosphor powder applied is one of the several phosphors employed in the screen structure for providing one of the several emission colors. Where several phosphors are applied, steps 5 through 12 are repeated for each phosphor powder, each providing a different emission color for the screen structure. The exposure step 7 is offset slightly for each of the phosphors so that the final screen structure has a multiplicity of discrete areas of the different emission colors offset from one another.

The screen may then be overcoated with an organic volatilizable specular film by one of the several conventional techniques such as flotation filming, spray filming or emulsion filming. The filmed screen structure may then be coated with a conducting metal layer, preferably aluminum, as by vapor deposition in a vacuum. Then the faceplate panel may be incorporated into a cathode-ray tube in the manner known in the prior art.

I claim:

1. A method for producing a luminescent screen structure including the steps of a. coating a supporting surface with a film consisting essentially of (i) organic polymeric binder material whose solubility in a given solvent is altered when it is exposed to radiant energy, said binder material being volatilized when heated in air below about 500°C and (ii) about 10 to 80 weight percent with respect to the weight of said binder material of particles of an organic material that is insoluble in said binder material and selected from the group consisting of acrylic and polystyrene polymers, said particles being volatilized when heated in air at temperatures below about 500°C and being about 0.3 to 1.0 micron median size, said organic particles being adapted to scatter said radiant energy in said film, b. exposing said film to an image in the form of said radiant energy until the solubility of the irradiated portions thereof is selectively altered, thereby producing in said film regions of greater solubility and regions of lesser solubility, c. removing those regions of said film with greater solubility with a liquid solvent therefor while retaining said regions with lesser solubility, thereby baring the areas of said supporting surface underlying said regions of greater solubility, while retaining those regions of said film of lesser solubility, d. then, while said retained film regions are wet with said solvent, adhering dry particles of screen-structure material to said film regions of lesser solubility, e. and then baking said retained film regions with said adhered particles thereon in air at temperatures below about 500°C until said binder material and said organic particles are substantially entirely volatilized.

2. The method defined in claim 1 wherein step (d) is conducted after step (b) and before step (c).

3. The method defined in claim 1 wherein step (d) is conducted after step (c).

* * * * *